US008678794B2

(12) United States Patent
Iversen et al.

(10) Patent No.: US 8,678,794 B2
(45) Date of Patent: Mar. 25, 2014

(54) REFRIGERANT COMPRESSOR ARRANGEMENT HAVING A TELESCOPIC TUBE IN SUCTION OPENING

(75) Inventors: Frank Holm Iversen, Padborg (DK); Marten Nommensen, Flensburg (DE); Heinz Otto Lassen, Flensburg (DE); Ekkehard Handke, Grossenwiehe (DE); Dirk Sommer, Holt (DE)

(73) Assignee: Secop GmbH, Flensburg (DE)

( * ) Notice: Subject to any disclaimer, the term of this patent is extended or adjusted under 35 U.S.C. 154(b) by 857 days.

(21) Appl. No.: 12/354,850

(22) Filed: Jan. 16, 2009

(65) Prior Publication Data

US 2009/0229303 A1 Sep. 17, 2009

(51) Int. Cl.
*F04B 39/12* (2006.01)

(52) U.S. Cl.
USPC ..... 417/572; 417/312; 417/902

(58) Field of Classification Search
USPC ..... 137/316; 138/118, 177, 178; 181/262, 181/263, 403; 215/358; 220/801; 403/50, 403/51, 288; 417/312, 572, 902, 410.1, 417/410.5; 427/154, 156, 264, 282, 287; 277/636; 285/145.1, 145.2
See application file for complete search history.

(56) References Cited

U.S. PATENT DOCUMENTS

| | | | | |
|---|---|---|---|---|
| 2,551,325 A | | 5/1951 | Hardie | |
| 3,902,629 A | * | 9/1975 | Kushner | 418/248 |
| 4,456,269 A | * | 6/1984 | Krude et al. | 277/636 |
| 4,784,581 A | * | 11/1988 | Fritchman | 417/312 |
| 4,969,804 A | | 11/1990 | Gannaway | |
| 5,803,717 A | * | 9/1998 | Iversen et al. | 417/312 |
| 6,171,084 B1 | * | 1/2001 | Wallis et al. | 418/55.1 |
| 6,251,468 B1 | * | 6/2001 | Balter | 427/11 |
| 2005/0135955 A1 | | 6/2005 | Iversen et al. | |

FOREIGN PATENT DOCUMENTS

| | | |
|---|---|---|
| DE | 4411191 A1 | 10/1995 |
| DE | 296 14 105 U1 | 10/1996 |
| DE | 103 59 562 A1 | 7/2005 |
| DE | 10359562 A1 | 7/2005 |

OTHER PUBLICATIONS

Definition of arch, retrieved from www.merriam-webster.com on Apr. 4, 2013.*

* cited by examiner

*Primary Examiner* — Nimeshkumar Patel
*Assistant Examiner* — Steven Horikoshi
(74) *Attorney, Agent, or Firm* — McCormick, Paulding & Huber LLP

(57) ABSTRACT

The invention concerns a refrigerant compressor arrangement (1) with a housing (2, 3) comprising a suction opening (5), a compressor (15), which is arranged in the housing (2, 3), and is connected to the suction opening (5), and a suction connection (20) that is fixed at the housing (2, 3), and comprises a housing section (21) and a tube section (22), the housing section (21) being connected to the suction opening (5) and the diameter of the tube section (22) being different from the diameter of the housing section (21). With such a refrigerant compressor arrangement, it is endeavoured to keep the dimensions small. For this purpose, in the longitudinal direction of the suction connection (20) the housing section (21) and the tube section (22) overlap each other and are connected to each other by a corrugated area (23) with at least one radial corrugation.

19 Claims, 1 Drawing Sheet

Fig.1
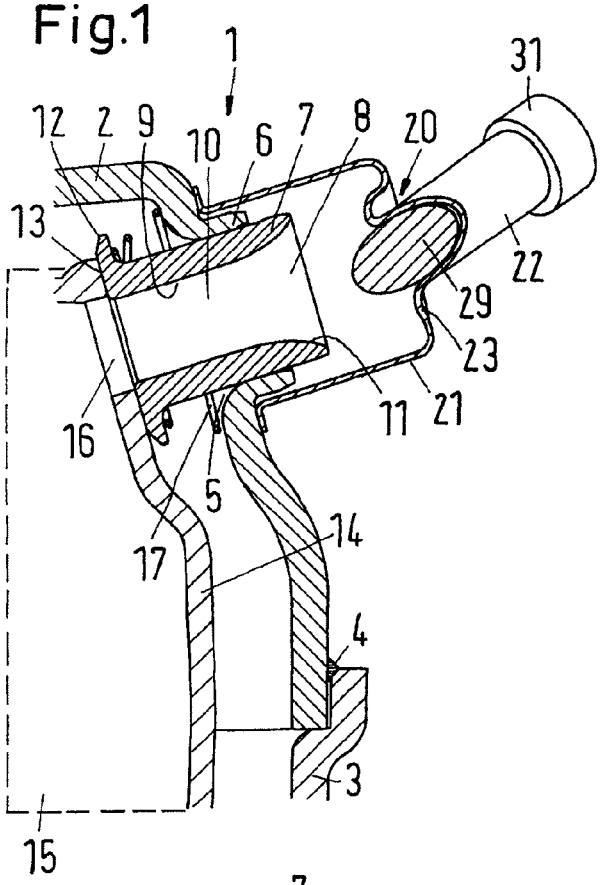
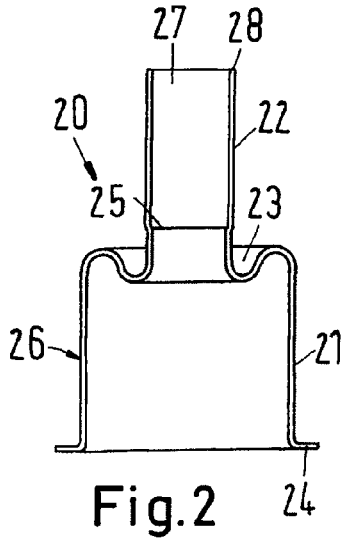
Fig.2
Fig.3
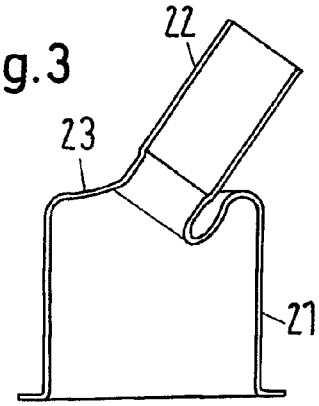
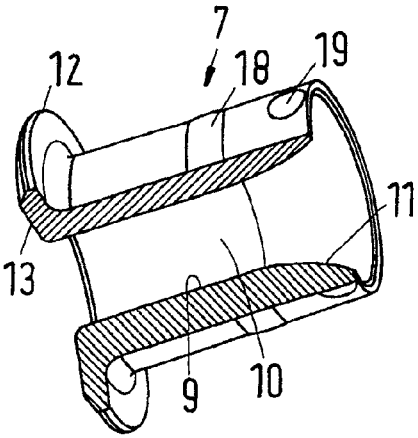
Fig.4
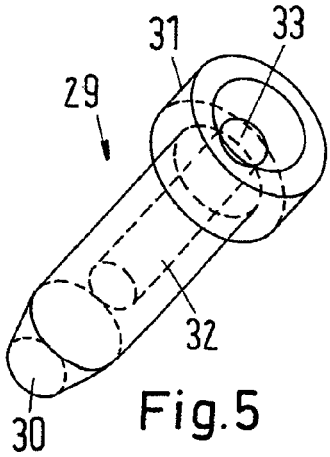
Fig.5

REFRIGERANT COMPRESSOR ARRANGEMENT HAVING A TELESCOPIC TUBE IN SUCTION OPENING

CROSS REFERENCE TO RELATED APPLICATION

Applicant hereby claims foreign priority benefits under U.S.C. §119 from German Patent Application No. 10 2008 004 790.2 filed on Jan. 17, 2008, the contents of which are incorporated by reference herein.

FIELD OF THE INVENTION

The invention concerns a refrigerant compressor arrangement with a housing comprising a suction opening, a compressor, which is arranged in the housing, and is connected to the suction opening, and a suction connection that is fixed at the housing, and comprises a housing section and a tube section, the housing section being connected to the suction opening and the diameter of the tube section being different from the diameter of the housing section.

BACKGROUND OF THE INVENTION

Such a refrigerant compressor arrangement is, for example, known from DE 103 59 562 A1. The compressor has a suction muffler, on which a telescopic tube bears, which is lead through the suction opening in the housing. The suction connection is mounted on the suction opening and the telescopic tube and fixed at the housing. Thus, it is possible for the compressor to move somewhat in the housing without interrupting a connection from a piping system via the suction connection to the compressor.

Between the housing section and the tube section, the suction connection has a corrugated tube like area, which permits an adaptation to customer specific mounting conditions in a refrigeration system. This adaptation is very advantageous, if the same refrigerant compressor arrangement is to be used in different refrigeration systems or refrigeration appliances. However, it has the disadvantage that the dimensions of the refrigerant compressor arrangement are increased. The area in a refrigeration appliance, that is, a refrigerator or a freezer, which is used to accommodate the refrigerant compressor arrangement, is not available for utilisation purposes.

SUMMARY OF THE INVENTION

The invention is based on the task of keeping the dimensions small.

With a refrigerant compressor arrangement as mentioned in the introduction, this task is solved in that in the longitudinal direction of the suction connection the housing section and the tube section overlap each other and are connected to each other by a corrugated area with at least one radial corrugation.

With this embodiment, the advantage is maintained that the tube section of the suction connection, which is connected to the piping system of a refrigeration or cooling system for circulating the refrigerant, can, within certain limits, be aligned freely. In particular, the inclination of the tube section in relation to the housing section can be changed. Still, the length of the suction connection and thus the dimensions of the refrigerant compressor arrangement are kept small, as the tube section projects, at least partly, into the housing section or extends over it. The connection between the tube section and the housing section then still occurs via a corrugated area. The alignment of the corrugated area, however, is substantially radial. The corrugation extends from the radial inside to the radial outside, so that it can also connect the tube section and the housing section to each other, when these sections, in a manner of speaking, extend into each other. The present description of the suction connection applies for the non-deformed state, in which the tube section and the housing section are arranged coaxially next to each other and have the same alignment. Apart from the opportunity of keeping the dimensions small, the radial corrugation also offers an improved deformability, that is, the tube section can be more heavily deformed in relation to the housing section, than it was possible in the state of the art.

Preferably, the end of the suction connection facing the housing has a fixing connector. This increases the bearing surface between the suction connection and the housing, so that a gas-tight connection can be made in a simple manner, for example by means of friction welding or laser welding. Other methods of connecting, for example soldering or resistance welding, are of course also possible.

Preferably, the outside of the suction connection is provided with a paint rejecting layer. The suction connection in itself is preferably made of steel, which is covered by a thin copper layer. As, during mounting of the refrigerant compressor arrangement in a refrigeration system or a refrigeration appliance, the suction connection is to be connected to a piping system of the refrigerant or the refrigeration system, the copper surface of the suction connection simplifies the connection to the piping system, for example by means of soldering. A paint layer, which is usually required to protect the housing, would rather harm the soldering connection. The layer rejecting the paint now permits the mounting of the suction connection at the housing before providing the housing with paint, without risking that the suction connection will then have a poorer mounting behaviour.

Preferably, the layer can be liquefied by a heat supply. Usually, the housing is provided with a baking varnish or dried by means of a heat supply after applying the paint. When, now, the layer is made so that the temperature then ruling will liquefy it, it may be ensured that, in a manner of speaking, the paint rejecting layer disappears from the suction connection by itself. When, during drying or baking the varnish, the refrigeration compressor arrangement is suspended so that the suction connection faces downwards, the layer will drip off downwards without acting upon the surface of the housing.

Preferably, the compressor is connected to a telescopic tube led through the suction opening, the maximum length of the telescopic tube projecting through the housing being shorter than a smallest distance between the housing and the corrugated area. The telescopic tube makes it possible for the compressor to move in relation to the housing during operation, without interrupting or causing gaps in a gas-tight connection between the suction connection and the compressor. During transport of the refrigerant compressor arrangement, larger movements between the compressor and the housing may appear. If, now, the telescopic tube is dimensioned so that during the largest deflection of the compressor in relation to the housing it cannot be displaced so much that it touches the corrugated area, damage to the corrugated area caused by the telescopic tube is reliably prevented.

Preferably, the telescopic tube has an opening that extends in the direction of the inside of the suction connection. This extension may, for example, occur via a rounding. This results in a reduction of the flow resistance for the refrigerant gas flowing into the telescopic tube. Particularly when the tube section extends into the housing section of the suction connection, this may give very favourable flow conditions for the refrigerant gas, as practically no projections are present, which could cause an eddying of the refrigerant gas.

Preferably, the telescopic tube is made of a fibre-reinforced plastic material and rests on a guiding surface of the compressor, which is free of fibres. The use of a fibre-reinforced plastic material, for example PBT (polybutylene terephtalate), has the advantage that the telescopic tube is sufficiently resistant to the refrigerant gas, and it does not wear so quickly, also with a plurality of movements in relation to the housing. The fibres reinforcing the plastic material increase the mechanical stability. At the same time, the use of plastic material for the telescopic tube reduces the transfer of heat from the compressor to the refrigerant gas flowing in. Thus, the refrigerant gas remains colder. The colder the gas is, the better is the efficiency of the compressor. The telescopic tube bears on the compressor, usually on a suction muffler, which is also made of a plastic material. When, now, this plastic material is kept free of fibres, at least in area of the guiding surface, excellent sliding properties between the suction muffler and the telescopic tube occur, so that the risk of leakages between the telescopic tube and the compressor remains small, when the compressor moves in relation to the housing.

It is also advantageous, if the circumference of the telescopic tube has a circumferential projection, which is arched in the axial direction. In this connection, the cross-section of the arch can follow a circular line, or rather a section of the circular line. This projection has the advantage that the inclination of the telescopic tube in relation to the housing can change within certain limits, without causing a larger leakage through a gap between the telescopic tube and the housing. Also during an angular change between the housing and the telescopic tube, the telescopic tube will surround the suction opening in a tightening manner.

Preferably, the tube section has an opening, into which a plug is inserted. Thus, the suction connection is always open at its tube-side end. Therefore, no part must be broken or cut off from the suction connection before mounting. On the contrary, it is sufficient to remove the plug. Thus, the risk is kept small that during tearing, breaking or cutting off a more substantial damage to the suction connection occurs. Such damage could occur in the form of hair cracks, which are not right away recognizable.

Preferably, the plug has a thickening that can rest on a front side surrounding the opening. Such a thickening can, for example, be formed by a head, which has a larger radius than the tube section of the suction connection.

This head has two advantages. Firstly it prevents the plug from being pressed or pushed too far into the suction connection. Thus, the plug is always accessible for a tool or an installer. Secondly, the head creates a contact contour between the plug and the tube section of the suction connection, which is angled. The risk that contaminants can reach the inside of the suction connection through such an angled contact area is relatively small.

Preferably, the plug is made of an elastically ductile material and has an axially extending channel, which is open towards an end, and in which a spreader tool can be inserted. Thus, the fixing of the plug in the suction connection occurs in that first the plug is inserted in the tube section of the suction connection and then the spreader tool is inserted in the channel. This will expand the plug somewhat radially, so that it is fixed in the tube section of the suction connection. The spreader tool can simply be a pin, which has a slightly larger diameter than the inner diameter of the channel. When removing the plug, first the spreader tool is pulled out of the plug. This is possible without problems and without having to handle the suction connection. After pulling out the spreader, the plug contracts somewhat in the radial direction, so that the friction between the plug and the suction connection is reduced so much that the plug can be pulled out of the suction connection with the use of little force.

Preferably, the plug has a conically bevelled insertion end. This simplifies the mounting.

BRIEF DESCRIPTION OF THE DRAWINGS

In the following, the invention is described on the basis of a preferred embodiment in connection with the drawings, showing:

FIG. 1 is a partial section of a refrigerant compressor arrangement,

FIG. 2 shows a suction connection in the non-deformed state,

FIG. 3 shows the suction connection in the deformed state,

FIG. 4 is a telescopic tube, partly in section; and

FIG. 5 is a plug.

DETAILED DESCRIPTION OF THE PREFFERED EMBODIMENTS

A refrigerant compressor arrangement 1, which is shown in partial section in FIG. 1, has a housing with an upper part 2 and a bottom part 3, the upper part 2 and the bottom part 3 being connected to each other in a gas-tight manner by means of a weld seam 4.

The upper part 2 has a suction opening 5, which is surrounded by an outwardly bent expansion 6. In a manner of speaking, the suction opening 5 is thus led through a small tube, which is made in one piece with the upper part 2 of the housing.

Through the suction opening 5 is led a telescopic tube 7, which has at the end extending through the suction opening 5 an expanding opening 8. For this purpose a wall 9, which surrounds a through channel 10 of the telescopic tube 7, has a curved section 11, whose curvature radius is relatively large.

At the other end, the telescopic tube has a flange 13, which bears with a bearing surface 13 on a suction muffler 14 of an otherwise merely schematically shown compressor 15. The suction muffler has an inlet opening 16, which is overlapping the through channel 10.

On the side of the flange 12 opposite the bearing surface 13 a spring 17 is arranged, which is supported on the inside of the upper part 2. This spring 17 is made to be conical, so that it can be completely compressed and then only has a thickness that corresponds to the thickness of the wire of the spring.

As can be seen from FIG. 4, the telescopic tube has a circumferential projection 18, whose outside is arched. To be more accurate, the projection 18 has a pitch circle shaped cross-section. With the projection 18 the telescopic tube bears in the expansion 6 at the upper part of the housing. Thus, it is possible that the telescopic tube 7 can be inclined within certain limits in relation to the upper part 2 without giving rise to a gap between the telescopic tube 7 and the expansion 6.

The telescopic tube 7 is made of a fibre-reinforced plastic material, for example of PBT with a share of 10% glass. This gives a good mechanical stability and a relatively good thermal isolation to reduce a heat transfer from the hot compressor to the suction gas.

The suction muffler 14 is also made of a plastic material. At least in the position, in which the telescopic tube 7 bears on the suction muffler 14, however, the plastic material of the suction muffler is free of fibre reinforcement. This gives good frictional properties between the telescopic tube 7 and the suction muffler 14, that is, an easy sliding of the flange 12 on the surface of the suction muffler 14.

Further, the circumferential surface of the telescopic tube has three or more projections 19, namely where the wall of the telescopic tube in the area of the opening 8 is thinnest. These projections 19 serve the purpose of retaining the telescopic tube 7 in the upper part 2 as long as the compressor 15 has not been mounted in the housing. When inserting the telescopic tube 7 in the suction opening 5, the telescopic tube 7 is somewhat compressed in the area of the projections 19, so that it can get through the suction opening 5. Without a corresponding force, which can, however, not be provided by the spring 17, the telescopic tube cannot be pulled out of the suction opening 5.

A suction connection 20 is fixed on the outside of the upper part 2, thus surrounding the expansion 6 and the suction opening 5. The suction connection 20 will be explained in detail on the basis of FIGS. 2 and 3.

The suction connection 20 has a housing section 21 and a tube section 22. The housing section 21 and the tube section 22 are connected to each other via a corrugated area 23. The corrugated area 23 makes it possible, as can easily be seen from FIG. 2, that the tube section 22 extends somewhat into the housing section 21. Thus, the housing section 21 and the tube section 22 overlap each other somewhat.

In stead of the one corrugation shown, the corrugated area 23 can also have two or more corrugations.

The end of the housing section 21 facing away from the corrugated area 23 has a connection flange 24, which can, for example, have the form of a welding flange. In the mounted state of the suction connection 20, the connection flange 24 bears on the outside of the upper part 2. Here it can be fixed by soldering or welding, particularly resistance welding, friction welding or laser welding.

The tube section 22 has a diameter reduction 25. This reduction forms a "stop" for a tube of a refrigeration system or a refrigeration appliance to be connected to the refrigerant compressor arrangement 1.

As shown by a comparison of the FIGS. 2 and 3, the corrugated area 23 permits a relatively large bending of the tube section 22 in relation to the housing section 21 without risking a deformation of the housing section 21 or the tube section 22 itself. The deformation is practically limited to the corrugated area 23.

The surface of the suction connection 20, particularly the outer surface, is provided with a paint rejecting layer 26, for example a wax. This layer is liquefied when acted upon by heat. When the suction connection 20 has been fixed at the upper part 2 of the housing and the refrigerant compressor arrangement is also otherwise finished, the housing 2, 3 is usually varnished. In order to dry the varnish, the refrigerant compressor arrangement 1 is heated. This will melt the layer 26, which drips off from the refrigerant compressor arrangement. If, during drying, the refrigerant compressor arrangement 1 is suspended so that the suction connection 20 is facing downwards, the layer 26 drips into the free space, without acting upon other parts of the refrigerant compressor arrangement 1.

As can be seen from FIG. 2, the end of the tube section 22 facing away from the corrugated area is open, that is, an opening 27 is provided here, which is surrounded by a front side 28. In order to prevent contaminants from reaching the inside of the refrigerant compressor arrangement 1, as long as the tube of the refrigeration system or the refrigeration appliance has not yet been mounted, a plug 29 is inserted in the tube section 22. The plug 29 can also be somewhat longer than the tube section 22.

The plug 29 has a conical insertion end 30, so that it can easily be inserted in the tube section 22 through the opening 27. At the other end, the plug 29 has a head 31 as a thickening. Then, when the plug 29 has been inserted in the tube section 22, the head 31 bears on the front side 28.

The plug 29 has a non-through channel 32, which opens towards the end, at which the head 31 is located. A spreader tool 33 can be inserted in the channel, in the simplest case a rod with a cross-section that is somewhat larger than the cross-section of the channel 32. The plug 29 is made of an elastically ductile material. When the plug 29 has been inserted in the suction connection 20, the spreader tool 33 is inserted in the channel 32. This will expand the plug 29 so that it is fixed in the tube section 22 with a certain pretension, meaning that it cannot fall out by itself. When the plug 29 is to be removed, the spreader tool 33 is removed first. Then, the plug 29 can be pulled out of the suction connection 20 with only little force. Here, the head 31 facilitates the handling by an installer or an automatic tool.

The telescopic tube 7 has a length, which is dimensioned so that the telescopic tube will not in any situation hit against the corrugated area 23. Even in the case that the telescopic tube 7 projects completely from the upper part 2, the length of the section of the telescopic tube 7 projecting from the upper part 2 is smaller than the distance between the corrugated area 23 and the outside of the upper part 2.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A refrigerant compressor arrangement with a housing comprising a suction opening, a compressor, which is arranged in the housing, and is connected to the suction opening, and a suction connection that is fixed at the housing in a gas-tight connection, and comprises a housing section and a tube section, the housing section being connected to the suction opening and the diameter of the tube section being different from the diameter of the housing section, wherein in the longitudinal direction of the suction connection the housing section and the tube section overlap each other and are connected to each other by a corrugated area with at least one radial corrugation;

wherein the compressor is connected to a telescopic tube led through the suction opening; and wherein a circumference of the telescopic tube has a circumferential projection, which is arched in the axial direction and in contact with an inner circumference of a portion of the housing surrounding the suction opening to form a seal between the telescope tube and the housing.

2. The refrigerant compressor arrangement according to claim 1, wherein the end of the suction connection facing the housing has a connection flange.

3. The refrigerant compressor arrangement according to claim 1, wherein the outside of the suction connection is provided with a paint rejecting layer.

4. The refrigerant compressor arrangement according to claim 3, wherein the layer can be liquefied by a heat supply.

5. The refrigerant compressor arrangement according to claim 1, wherein the maximum length of the telescopic tube projecting through the housing being shorter than a smallest distance between the housing and the corrugated area.

6. The refrigerant compressor arrangement according to claim 5, wherein the telescopic tube has an opening that extends in the direction of the inside of the suction connection.

7. The refrigerant compressor arrangement according to claim 5, wherein the telescopic tube is made of a fibre-reinforced plastic material and rests on a guiding surface of the compressor, which is free of fibres.

8. The refrigerant compressor arrangement according to claim 1, wherein the tube section has an opening, into which a plug is inserted.

9. The refrigerant compressor arrangement according to claim 8, wherein the plug has a thickening that can rest on a front side surrounding the opening.

10. The refrigerant compressor arrangement according to claim 8, wherein the plug is made of an elastically ductile material and has an axially extending channel, which is open towards an end, and in which a spreader tool can be inserted.

11. The refrigerant compressor arrangement according to claim 1, wherein the plug has a conically bevelled insertion end.

12. A refrigerant compressor arrangement comprising:

a housing having a suction opening;

a compressor arranged in the housing, the compressor connected to the suction opening by a telescopic tube led through the suction opening;

a suction connection including a housing section and a tube section, the housing section fixed to the housing at the suction opening in a gas-tight connection to connect the housing section to the suction opening;

wherein a circumference of the telescopic tube has a circumferential projection that is arched in the axial direction and in contact with an inner circumference of a portion of the housing surrounding the suction opening to form a seal between the telescopic tube and the housing;

wherein a diameter of the tube section is different from a diameter of the housing section; and wherein the housing section and the tube section overlap each other in the longitudinal direction of the suction connection and are connected to each other by a corrugated area with at least one radial corrugation.

13. The refrigerant compressor arrangement according to claim 12, wherein the end of the suction connection facing the housing has a connection flange.

14. The refrigerant compressor arrangement according to claim 12, wherein the maximum length of the telescopic tube projecting through the housing being shorter than a smallest distance between the housing and the corrugated area.

15. The refrigerant compressor arrangement according to claim 14, wherein the telescopic tube is made of a fibre-reinforced plastic material and rests on a guiding surface of the compressor, which is free of fibres.

16. The refrigerant compressor arrangement according to claim 12, additionally comprising a plug that is inserted into an opening in the tube section of the suction connection.

17. The refrigerant compressor arrangement according to claim 16, wherein the plug has a thickening portion that rests on a front side of the tube section surrounding the opening.

18. The refrigerant compressor arrangement according to claim 16, wherein the plug is made of an elastically ductile material and has an axially extending channel, which is open towards an end, and in which a spreader tool can be inserted.

19. The refrigerant compressor arrangement according to claim 16, wherein the plug has a conically bevelled insertion end.

* * * * *

UNITED STATES PATENT AND TRADEMARK OFFICE

CERTIFICATE OF CORRECTION

PATENT NO. : 8,678,794 B2
APPLICATION NO. : 12/354850
DATED : March 25, 2014
INVENTOR(S) : Frank Holm Iversen et al.

It is certified that error appears in the above-identified patent and that said Letters Patent is hereby corrected as shown below:

On the title page insert:

item --(30) Foreign Application Priority Data

January 17, 2008 (DE).....10 2008 004 790.2--

Signed and Sealed this
Thirtieth Day of September, 2014

Michelle K. Lee

Michelle K. Lee
*Deputy Director of the United States Patent and Trademark Office*